United States Patent [19]

Stauch, deceased et al.

[11] 4,315,560

[45] Feb. 16, 1982

[54] SILENCER FOR AIRCRAFT PISTON ENGINE

[76] Inventors: Philipp E. Stauch, deceased, late of Neunkirchen, Fed. Rep. of Germany; by Thea Stauch, heir, Homburger Str. 51, 6680 Neunkirchen; by Dieter Stauch, heir, Hauptstrasse 72, 6661 Saarbrücken-Klarenthal, both of Fed. Rep. of Germany

[21] Appl. No.: 224,226

[22] PCT Filed: Oct. 22, 1979

[86] PCT No.: PCT/DE79/00124

§ 371 Date: Jun. 21, 1980

§ 102(e) Date: Jun. 18, 1980

[87] PCT Pub. No.: WO80/00861

PCT Pub. Date: May 1, 1980

[30] Foreign Application Priority Data

Oct. 21, 1978 [DE] Fed. Rep. of Germany ..... 2845902

[51] Int. Cl.[3] ..... F01N 7/20; F01N 1/08

[52] U.S. Cl. ..... 181/275

[58] Field of Search ..... 181/247–251, 181/255, 268–269, 272, 273, 275

[56] References Cited

U.S. PATENT DOCUMENTS 4,109,750 8/1978 Wirt ..... 181/252 X

FOREIGN PATENT DOCUMENTS 263701 1/1927 United Kingdom .

568140 3/1945 United Kingdom .

*Primary Examiner*—L. T. Hix

*Assistant Examiner*—Thomas H. Tarcza

*Attorney, Agent, or Firm*—Schwartz, Jeffery, Schwaab, Mack, Blumenthal & Koch

[57] ABSTRACT

The noise damping device for piston motors in aircrafts, which allows the simultaneous cooling of the exhaust gases, offers a square cross section and a variable configuration according to the direction of the exhaust. The exterior sheets (3,4) converge towards the exhausts direction into a slot-like output aperture (7), while the lateral sheets (5,6) diverge in the same direction so that the profile of the exterior sheets diverges and that of the lateral sheets converges. Perforated sheets (8,9) are placed in parallel to and at a distance from the internal surfaces of the exterior converging sheets (3,4) and comprise edges (8*a*, 9*a*) forming cooling chambers (10,11) which are open towards the outlet aperture (7). The diverging lateral sheets (5,6) can also be fitted with holes which open into lateral supplementary cooling chambers, which chambers are open towards the side of the outlet aperture.

8 Claims, 7 Drawing Figures

SILENCER FOR AIRCRAFT PISTON ENGINE

Figure 1:
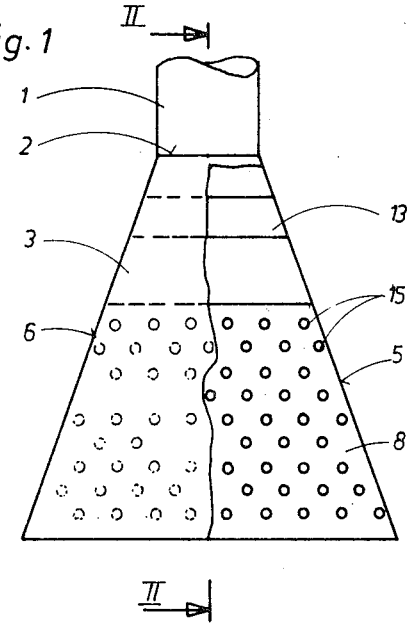

The invention relates to a silencer for aircraft piston engines having inner perforated sheet metal elements and at least one tubular joining sleeve for connection to an exhaust gas conduit. Perforated sheet elements inside of the silencers have the function of interrupting and deviating the exhaust gas flow in order to thereby destroy the sound energy.

Propeller driven aircraft with an aircraft piston engine drive, which are utilized mainly as private travel and as sports aircraft, have normally no silencers. The established official noise limit values require therefore that motors be so designed that the exhaust noise does not exceed these limit values. Accordingly, one is not at liberty to optimize the valve times and the number of revolutions in view of a possible maximum power of the engine. Ultimately, the official regulations regarding noise limit values lead to a kind of throttling of the aircraft engines as long as they operate without a silencer. On the other hand, the utilization of a silencer has meant also a certain loss of power output.

It is, therefore, an object of the invention to provide a silencer for aircraft piston engines which reduces the noise level without adversely affecting the power output of the aircraft engine dependent on the number of revolutions. The object is attained by means of the criteria recited in the characteristic clause of claim 1.

The feature (a) determines the outer design of the silencer according to the invention which has a rectangular cross section with a configuration that varies in the flow direction. Due to the divergence of the lateral terminal sheets which is gradually larger than the convergence of the forward and rearward outer sheets representing the long sides of the cross section rectangle, the surfaces of the converging outer sheets are substantially increased up to the slit-like exit opening without requiring that the cross section surface of the inner chamber of the silencer increase in the flow direction. By the feature (b), cooling chambers are created beneath the outer sheets which broaden in the flow direction and into which the exhaust gases flow through perforated sheets which extend parallel to the outer sheets. As the propeller stream passes along the outer sheets, the exhaust gases are subjected inside the cooling chambers before their discharge to a cooling which is accompanied by a reduction of volume. This reduction of volume is the novel effect of the silencer according to the invention, as it exerts a certain constant suction on the pulsating sound waves at the inlet of the silencer and has to that extent a smoothing effect.

It is recommended to provide between the region of the cooling chambers and the joining sleeve a vortex chamber which is defined by the outer and terminal sheets and in which a ledge type angled baffle piece is arranged which extends between the lateral terminal sheets. This angled baffle piece acts as reflection surface for sound waves and simultaneously for the deflections and division of the exhaust flow in order to reduce the velocity component of the exhaust flow and to promote that the exhaust gases enter as much as possible into all the holes of the perforated sheets which extend substantially in the flow direction.

As described so far, the diverging lateral terminal sheets along which the propeller stream also passes, are utilized only in the area of the vortex chamber and the front sides of the two aforementioned cooling chambers for the cooling effect. By means of the criteria of claim 3, it is obtained by that partial flows of the exhaust gases are exposed in the area of the narrow, lateral terminal surfaces of the silencer also to the cooling effect of the flow of air.

A further improvement of the cooling effect is obtained by providing a cooling slit in accordance with claim 4 passing through the silencer and open in the area of the lateral terminal sheets, said slit permitting the entrance of external air inside the silencer and having exhaust gases flowing around its lateral walls which extend to the slot-like opening. In this form of embodiment, the exhaust gases are cooled not only by means of heat transfer by the converging outer sheets, but also by heat transfer at the inner walls of the cooling slit.

The cross section of slot like exit opening for the exhaust gases should be approximately as large as the cross section of the joining sleeve. This means that an expansion of the exhaust gases inside the silencer is not sought because the suction for smoothing the sound waves is obtained according to the invention by the substantial cooling and the volume decrease of the exhaust gases. Due to the volume decrease of the exhaust gases, the slot like exit opening can be smaller in cross section than that of the joining sleeve.

The sum of the cross sections of the holes in the perforated sheets is appropriately larger than the cross section of the joining sleeve on the inlet side, in order to avoid as much as possible the back pressure of exhaust gases inside the silencer.

The forward and rearward outer sheets include appropriately a convergence angle of 12° and the lateral terminal sheets a divergence angle of 40°.

As already known in heat exchangers, the sheets which are contacted by the cooling air, i.e. the propeller wind, can be provided with sheet metal ribs fixed thereon so as to increase the heat transfer surfaces and to guide the cooling air.

Figure 2:
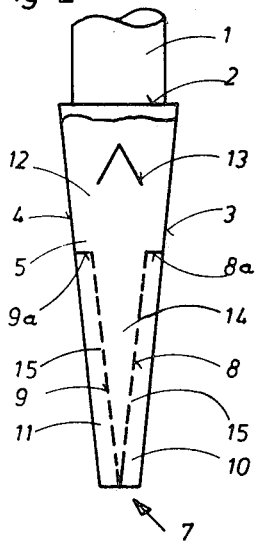
Figure 3:
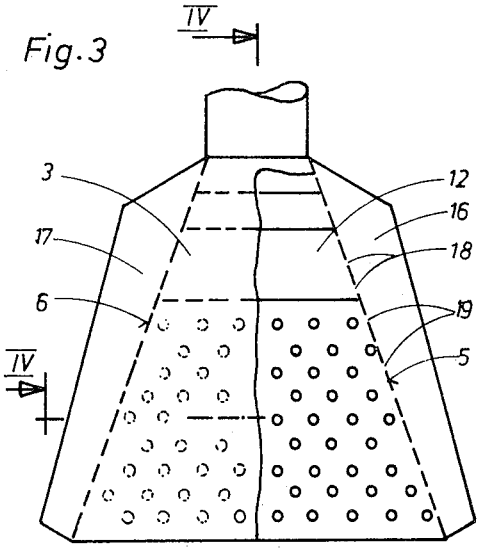
Figure 4:
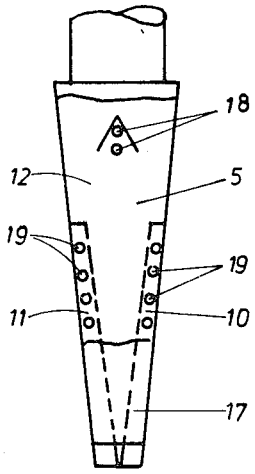
Figure 5:
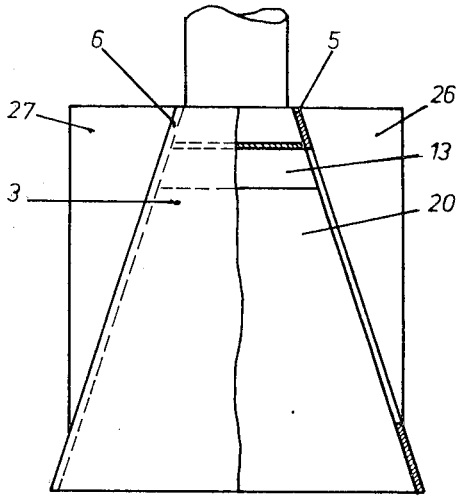
Figure 6:
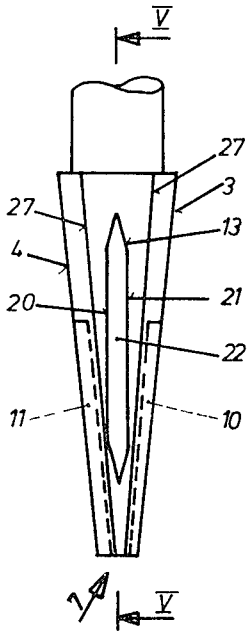
Figure 7:
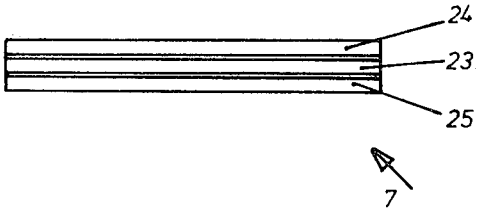

The invention will be described hereafter in greater detail with reference to the accompanying drawings in which three embodiments of a silencer according to the invention are illustrated and in which:

FIG. 1 shows a plan view of a forward outer sheet of a first embodiment, with the outer sheet partly cut away, FIG. 2 shows a vertical section along the line II—II in FIG. 1, FIG. 3 shows a plan view similar to FIG. 1 of a second embodiment, FIG. 4 shows a longitudinal section along the line IV—IV of FIG. 3, FIG. 5 shows a plan view similar to FIG. 1 of a third embodiment with an inner cooling slot partly in longitudinal section along the line V—V in FIG. 6, FIG. 6 shows a side view of FIG. 5 and, FIG. 7 shows a view from below of FIG. 5.

A silencer according to the invention consists in all the embodiment illustrated of a tubular joining sleeve 1 for joining the silencer to an exhaust conduit, a square transition flange 2 as connecting element for additional outer wall parts of the silencer, which result in a rectangular cross section of an inner chamber. These outer wall parts consist of forward and rearward outer sheets 3 and 4 which converge at an angle of about 12°, as shown in FIG. 2 and of narrower lateral terminal sheet 5 and 6, which diverge in the flow direction and comprise a divergence angle of about 40°. The converging outer sheets 3 and 4 are so dimensioned in their length that they provide a slot like exit opening 7. The length of the slot like exit opening 7 is a result of the divergence of the lateral terminal sheets 5 and 6 and the dimension ratios thereof assure that the cross section of the slot like exit opening 7 is approximately as large as the cross section of the joining sleeve 1 on the inlet side.

As the longitudinal section according to FIG. 2 shows there extend parallel to the forward and rearward outer sheets 3 and 4 in spaced relationship also converging perforated sheet 8 and 9 which on the inflow side are provided with bevelled portions 8a and 9a extending like the outer sheets 3 and 4, so that each perforated sheet with a bevelled portion forms with a forward or rearward outer sheet and with regions of the lateral terminal sheets diverging toward each other a cooling chamber 10 or 11. Each cooling chamber terminates in the slot like exit opening 7. The perforated sheets 8 and 9 can be brought together in the region of the exit opening 7 but they can also leave open a narrow partial slot of the exit opening 7.

Between the region of the cooling chambers 10, 11 and the joining sleeve 1, a vortex chamber 12 is provided which is limited by the outer and terminal sheets 3 to 6, and in this chamber a ledge type baffle angle piece 13 is arranged which extends between the lateral terminal sheets 5 and 6.

The structure of the silencer according to the invention described so far applies to all the embodiments. This is true also for the course of the exhaust flow which is described now with reference to FIGS. 1 and 2 in the following manner:

The exhaust gases flowing in over the joining sleeve 1 and the transition flange 2 strike first against the ledge type baffle angle piece 13 and are thus whirled around in the vortex chamber 12. The baffle angle piece 13 has in addition the effect of producing a sound deadening by reflection. The exhaust gases then enter into the narrowing intermediate chamber 14 between the cooling chambers 10 and 11 are received through the holes 15 of the perforated sheets 8 and 9 in the cooling chamber 10 and 11. In the right half of FIG. 1 is illustrated that the exhaust gases enter from below the perforated sheet 8 through the holes 15 into the cooling chamber 10 in the direction of the arrow, as in the right half of FIG. 1 the forward outer sheet 3 is illustrated partly cut away. The narrowing intermediate chamber 14 promotes the transfer of the exhaust gases into the cooling canals 10, 11 while the divergence of the lateral terminal sheets 5 and 6 promote an expansion of the exhaust flow in the longitudinal direction of the slot like exit opening 7. It is essential that the exhaust gases inside the cooling chamber 10, 11 travel along the broadening outer sheets 3, 4 which are contacted by the propeller wind so that they are cooled thereby.

In the embodiment illustrated in FIGS. 1 and 2, the lateral terminal sheets 5 and 6 which are contacted by the propeller wind are also contacted on the inside by the exhaust gases but the surface of the lateral terminal sheets 5 and 6 is relatively small. In the embodiment of FIGS. 3 and 4 are therefore provided outside the lateral terminal sheets 5 and 6 cooling hoods 16, 17 whose canal type inner chambers are connected over holes 18 in the upper region of the terminal sheets 5, 6 with the vortex chamber 12. In the lower region the inner chambers of the cooling hoods 16, 17 are connected over holes 19 also with the two cooling chambers 10, 11 so that two partial flows travel from the vortex chamber 12 into the cooling hoods and from there into the cooling chambers 10, 11 which are open underneath. The flow course of the exhaust gases is shown in FIG. 3 by arrows namely in the right half of the drawing in which the forward outer sheet 3 as well as the side wall of the cooling hood 16 are cut away. In the sectional view of FIG. 4 one can see the entrance of flow threads through the holes 19 in the edge regions of the lateral terminal sheet 5 into the cooling chambers 10, 11. In the lower region of FIG. 4 a portion of the cooling hood 17 is shown in elevation.

The embodiment of FIGS. 5 to 7 corresponds essentially to the embodiment of FIGS. 1 and 2. The difference consists in an inner cooling slot 22 which on the inflow side is defined by the ledge type baffle angle piece 13 which is connected to a pair of walls 20, 21 that are parellel to each other. These walls 20, 21 extend through the narrowing intermediate chamber 14 (FIG. 2) between the lateral cooling chambers 10, 11 into the region of the outer opening 7. As can be seen from the view towards the outlet opening according to FIG. 7 the outlet slot 23 for the cooling slot 22 is positioned between the partial outlet slots 24, 25 of the cooling chambers 10, 11. The cooling slot 22 is open laterally for the entrance of cooling air in that the lateral terminal sheets 5, 6 are open over the interval of the walls 20, 21 as can be seen from the sectional representation of FIG. 5. In this figure is also shown by dotted line arrows the direction of the inflowing cooling air while in all the other figures the solid line arrows show the flow direction of exhaust gases.

As can be seen from FIGS. 5 and 6, there are positioned on the lateral terminal sheets 5, 6 on both sides of the cooling slot 22 in each case a pair of sheet metal ribs 26, 27 which not only increase the heat transfer surfaces for improving the cooling effect but also serve as guides for the cooling air. As shown in FIG. 6 a pair of metal ribs 27 extends in the flow direction with such an inclination to each other so that the cooling air flow coming from above is forced into the cooling slot 22 by a reduction of the flow canal.

Official sound level measurements according to the guide lines of the LBA LL/144-606.4/75 for the aircraft D-EHFM have shown in four measuring flights that the sound level of the average 76 dB(A) measured without silencer is reduced with the use of silencers according to the invention to 72 dB(A). At the same time, it was determined that the maximum motor rotation speeds of normally 2700 revolutions per minute increased with the use of the silencers according to the invention by 150 revolutions per minute and had to be taken back again. This is a proof that with the silencer of the invention not only the sound level is reduced but surprisingly also the motor speed and thus the motor power are increased.

What we claim is:

1. Silencer for aircraft piston engines having inner perforated metal sheets and at least one tubular joining sleeve for connecting to an exhaust gas conduit comprising:

(a) a rectangular cross section with a configuration varying in the flow direction in which the forward and rearward outer sheets associated with the long sides of the rectangle converge in the flow direction towards each other down to a slot like outlet opening and the lateral terminal sheets associated with the shorter sides of the rectangle diverge in the flow direction toward each other to the slot like outlet opening, (b) converging perforated sleeves extending parallel to and at a distance from the converging forward and rearward outer sheets and provided with bevelled portions on the inflow side and converging to the outer sheets so that each perforated sheet forms with a bevelled portion, a forward or rearward outer sheet, and regions of the lateral diverging terminal sheets a cooling chamber which is open and terminates in the slot like outlet opening, (c) a cooling chamber receiving the exhaust gases from the narrowing intermediate chamber between the converging perforated sheets over their holes and allowing them to escape in the region of the slot like outlet opening, wherein the exhaust gases after their deviation into the cooling chambers pass along the outer and lateral terminal sheets which are contacted by the propeller wind.

2. Silencer according to claim 1 wherein between the region of the cooling chamber and the joining sleeve and delimited by the outer and terminal sheet (a) a vortex chamber is provided in which is arranged between the lateral terminal sheets, (b) a ledge type baffle angle piece.

3. Silencer according to claim 2 wherein outside the lateral terminal sheets (a) cooling hoods are provided whose canal like inner chambers are connected over (b) holes in the lateral terminal sheets with the vortex chamber as well as with the two cooling chambers, (c) so that two partial flows of the exhaust gases are conducted from the vortex chamber into the cooling hoods and from there into the open cooling chambers.

4. Silencer according to claim 2 wherein a pair of parallel walls are connected to the baffle angle piece and form a cooling slot which extends in the narrowing intermedite chamber between the cooling chambers (a) said cooling slot being open in the region of the lateral terminal sheets for the entrance of the outside air and (b) terminating in its own slot like exit opening.

5. Silencer according to claim 4 wherein a cross section of the slot like outlet opening for the exhaust gases is about as large as the cross section of the joining sleeve.

6. Silencer according to claim 5 wherein the cross section of the sum of the holes in the perforated sheets is larger than the cross section of the joining sleeve.

7. Silencer according to claim 1 wherein the forward and the rearward outer sheets comprise a convergence angle of about 12° and the lateral terminal sheets a divergence angle about 40°.

8. Silencer according to one or several of the preceding claims wherein metal ribs are positioned on the sheets contacted by cooling air to enlarge the heat transfer surfaces and to guide the cooling air.

* * * * *